US011401927B2

(12) United States Patent
Li et al.

(10) Patent No.: US 11,401,927 B2
(45) Date of Patent: Aug. 2, 2022

(54) STATUS MONITORING AND FAILURE DIAGNOSIS SYSTEM FOR PLUNGER PUMP

(71) Applicant: American Jereh International Corporation, Houston, TX (US)

(72) Inventors: Hailong Li, Yantai (CN); Haiping Cui, Yantai (CN); Haiping Xing, Yantai (CN); Jixin Wang, Yantai (CN); Peng Li, Yantai (CN); Xiaobin Li, Yantai (CN)

(73) Assignee: AMERICAN JEREH INTERNATIONAL CORPORATION, Houston, TX (US)

( * ) Notice: Subject to any disclaimer, the term of this patent is extended or adjusted under 35 U.S.C. 154(b) by 0 days.

(21) Appl. No.: 17/331,635

(22) Filed: May 27, 2021

(65) Prior Publication Data

US 2021/0372395 A1 Dec. 2, 2021

Related U.S. Application Data

(63) Continuation-in-part of application No. 16/932,289, filed on Jul. 17, 2020, now Pat. No. 11,047,379.

(30) Foreign Application Priority Data

May 28, 2020 (CN) ..... 202010470707.4

(51) Int. Cl.
*F04B 9/02* (2006.01)
*F04B 49/06* (2006.01)
*F04B 51/00* (2006.01)

(52) U.S. Cl.
CPC ..... *F04B 49/065* (2013.01); *F04B 9/02* (2013.01); *F04B 51/00* (2013.01);
(Continued)

(58) Field of Classification Search
CPC ..... G01M 13/045; G01M 13/028; G01M 13/021; F04B 51/00
See application file for complete search history.

(56) References Cited

U.S. PATENT DOCUMENTS 5,772,403 A 6/1998 Allison et al.
6,192,864 B1 2/2001 Nishimura
(Continued)

FOREIGN PATENT DOCUMENTS

CN 109538460 A 3/2019
CN 111472971 A 7/2020

*Primary Examiner* — Jamel E Williams
(74) *Attorney, Agent, or Firm* — Xsensus LLP

(57) ABSTRACT

Disclosed is a status monitoring and fault diagnosis system for a plunger pump, including a monitoring and fault diagnosis device. The monitoring and fault diagnosis device monitors and diagnoses a hydraulic end assembly of a plunger pump. The monitoring and fault diagnosis device further monitors and diagnoses a power end assembly and/or a reduction gearbox assembly. Beneficial effects: The diagnosis system monitors and diagnoses not only a hydraulic end assembly, but also a power end assembly and/or a reduction gearbox assembly, that is, an equipment fault can be accurately predetermined in time for an entire plunger pump, so that high-pressure, large-displacement, and continuous operation requirements on fracturing sites at present are better satisfied, and on-demand maintenance is adopted instead of regular examination and maintenance, thereby saving labor, time, and materials to achieve economic efficiency.

20 Claims, 7 Drawing Sheets

(52) U.S. Cl.
CPC ..... *F04B 2201/0603* (2013.01); *F04B 2201/0801* (2013.01); *F04B 2201/0802* (2013.01); *F04B 2201/1207* (2013.01); *F04B 2201/1208* (2013.01); *F04B 2205/05* (2013.01)

(56) References Cited

U.S. PATENT DOCUMENTS

| | | | | |
|---|---|---|---|---|
| 10,823,176 | B2 | 11/2020 | Gu et al. | |
| 2004/0167738 | A1* | 8/2004 | Miller | F04B 51/00 702/114 |
| 2008/0196512 | A1 | 8/2008 | Miller | |
| 2010/0174496 | A1* | 7/2010 | Adnan | G01M 3/24 702/34 |
| 2011/0236225 | A1 | 9/2011 | Leugemors et al. | |
| 2012/0203507 | A1 | 8/2012 | Thomeer et al. | |
| 2018/0156015 | A1 | 6/2018 | Ding et al. | |
| 2018/0181830 | A1 | 6/2018 | Luharuka et al. | |
| 2018/0202433 | A1 | 7/2018 | Beisel | |
| 2018/0281284 | A1 | 10/2018 | Elgar et al. | |
| 2019/0022306 | A1 | 1/2019 | Gibson et al. | |

* cited by examiner

STATUS MONITORING AND FAILURE DIAGNOSIS SYSTEM FOR PLUNGER PUMP

CROSS-REFERENCE TO RELATED APPLICATIONS

This application is a continuation-in-part of U.S. application Ser. No. 16/932,289, filed Jul. 17, 2020, which claims priority to CN 202010470707.4, filed May 28, 2020, the entire contents of each are incorporated herein by reference.

TECHNICAL FIELD

The present disclosure relates to the technical field of plunger pumps, and specifically relates to a status monitoring and fault diagnosis system for a plunger pump.

BACKGROUND

A plunger pump for fracturing in oil fields is equipment for pumping a fracturing medium at a high pressure in mining in oil and gas fields. A common plunger pump for fracturing in an oil field is a plunger-type reciprocating volumetric pump and mainly includes a power end assembly, a hydraulic end assembly, and a reduction gearbox assembly. The power end assembly includes a power end housing, a crankshaft, a connecting rod, a crosshead mechanism, a crosshead case, and a retainer, and the like. The hydraulic end assembly includes a valve case, a plunger, a suction valve, a discharge valve, and the like. A power source such as a diesel engine, an electric motor or a turbine engine supplies power to drive the reduction gearbox assembly and the power end assembly. The power end assembly drives the plunger to linearly reciprocate in a sealed cavity of the valve case of the hydraulic end assembly. The suction valve and the discharge valve alternately work in the valve case of the hydraulic end assembly to implement high-pressure pumping of a fracturing medium. The plunger pump pumps the fracturing medium into the stratum at a high pressure to press open the stratum to form a fracture for enhancing production and injection in oil and gas fields. Therefore, for all the mining in oil and gas fields, a plunger pump of fracturing equipment is a part that is most prone to fault.

Currently, a maintenance manner such as planned maintenance and emergency maintenance is usually used for a plunger pump for fracturing on well sites in oil and gas fields. The planned maintenance is also referred to as regular preventive maintenance. Site worker are asked for disassembly check, maintenance, and parts replacement according to production planning and experiences after operation for a period of time. In such a maintenance system, disassembly check is required regardless of whether the equipment encounters fault, causing a waste of labor and materials. Such a practice is somewhat blind, uneconomical, and inappropriate. The emergency maintenance is maintenance after fault occurs. Such maintenance causes significant damages to equipment and requires high maintenance costs. In addition, during actual construction, parts of plunger pumps specifically used on different sites have significantly different and highly unpredictable service lives due to factors such as complex oil and gas bearing strata and pressure fluctuations in high-pressure pumping. In common maintenance manners at present, an operation status of a plunger pump cannot be accurately monitored, and the fault occurrence rate of the plunger pump cannot be predetermined, resulting in reduced utilization and a shorter service life of the plunger pump and potential safety hazards to normal production of enterprises. During the operation of the plunger pump, a power end assembly and a reduction gearbox assembly supply power to the plunger pump to pump a medium at a high pressure, and a hydraulic end assembly is in direct contact with the high-pressure medium. Therefore, the hydraulic end assembly is a part that is the most prone to fault in the plunger pump. This is also the reason why only the hydraulic end is examined in existing monitoring and fault diagnosis.

With the ongoing development of ultra-high-pressure wells, ultra-deep wells, and horizontal wells in oil and gas fields, working conditions of the wells become increasingly severe, and high-pressure and large-displacement operations are required. Particularly, in unconventional oil and gas work, for example, shale gas work, the working pressure is sometimes up to 120 MPa, the working condition is severe, and in addition, continuous, large-displacement, and high-pressure operations are required. Compared with previous conventional intermittent fracturing work in oil and gas fields, a plunger pump may be examined and repaired in working gaps. For continuous, large-displacement, and high-pressure working conditions of shale gas fracturing work, consequently, the examination and repair time need to be greatly shortened, and parts of the plunger pump are prone to wear and tear. In current severe working conditions such as shale gas exploitation, a hydraulic end of the plunger pump fails more frequently. In addition, power end faults and reduction gearbox faults often occur, and as a result fracturing equipment is often suddenly interrupted. A plunger pump for fracturing is expensive. Once a hydraulic end assembly, a power end assembly, and a reduction gearbox assembly are damaged, maintenance costs are high, and site construction is severely affected. At present, existing plunger pump status monitoring for monitoring only a hydraulic end can no longer satisfy requirements of current continuous, large-displacement, high-pressure working conditions. For the existing hydraulic end monitoring technology, the prediction is not highly targeted, and a professional worker is needed to perform monitoring and analysis. As a result, a plunger pump fault cannot be found in time, application is limited, and a plunger pump maintenance problem cannot be completely resolved.

In view of this, there is an urgent need for a system used for comprehensively monitoring and diagnosis of a plunger pump, which can satisfy current requirements of continuous, large-displacement, and high-pressure working conditions.

SUMMARY

An objective of the present disclosure is to overcome the deficiency of the prior art. The diagnosis system monitors and diagnoses not only a hydraulic end assembly, but also a power end assembly and/or a reduction gearbox assembly. That is, an equipment fault can be accurately predetermined in time for an entire plunger pump, so that parts of the plunger pump operate in an optimal state, and high-pressure, large-displacement, and continuous operation requirements on fracturing sites at present are better satisfied. Instead of regular examination and maintenance, on-demand maintenance is performed at a proper time according to the condition of the monitored plunger pump, thereby saving labor, time, and materials to achieve economic efficiency; problems, the position of a fault, and a part to be replaced can be found as soon as possible, so that sudden emergencies are prevented, damages are reduced, and maintenance costs are reduced; the utilization of the plunger pump is improved; and the service life of the plunger pump is extended.

One objective of the present disclosure may be achieved by using the following technical measure: A status monitoring and fault diagnosis system for a plunger pump may include a monitoring and fault diagnosis device, wherein the monitoring and fault diagnosis device monitors and diagnoses a hydraulic end assembly of a plunger pump, and the monitoring and fault diagnosis device further monitors and diagnoses a power end assembly and/or a reduction gearbox assembly.

Optionally, the monitoring and fault diagnosis device may include a plurality of sensors, a data acquisition module, and a data analysis and diagnosis module, the sensors are used for monitoring, the data acquisition module is connected to the sensors, the data acquisition module is configured to collect and transfer signals detected by the sensors to the data analysis and diagnosis module, and the sensors may include temperature sensors, vibration sensors, pressure sensors, and position sensors.

Optionally, the monitoring and fault diagnosis device monitors and diagnoses a crankshaft bearing of the power end assembly.

Optionally, sensors used for monitoring the crankshaft bearing are disposed on an outer surface of the crankshaft bearing, and the sensors used for monitoring the crankshaft bearing are a temperature sensor and a vibration sensor.

Optionally, the monitoring and fault diagnosis device monitors and diagnoses a crosshead mechanism of the power end assembly.

Optionally, sensors used for monitoring the crosshead mechanism are disposed on an outer surface of a crosshead case, and the sensors used for monitoring the crosshead mechanism are a temperature sensor and a vibration sensor.

Optionally, the monitoring and fault diagnosis device monitors and diagnoses a crankshaft of the power end assembly.

Optionally, a sensor used for monitoring the crankshaft is disposed on a side surface of a non-input end of the crankshaft, and the sensor used for monitoring the crankshaft is a position sensor.

Optionally, the monitoring and fault diagnosis of the hydraulic end assembly includes monitoring and fault diagnosis of a valve case, a liquid inlet manifold, and a discharge manifold.

Optionally, the monitoring and fault diagnosis of the valve case further includes monitoring and fault diagnosis of an upper valve and a lower valve.

Optionally, a sensor used for monitoring the upper valve and the lower valve is disposed on an outer surface of the valve case, and the sensor used for monitoring the outer surface of the valve case is a vibration sensor.

Optionally, the number of the vibration sensors disposed on the outer surface of the valve case is set correspondingly according to a specific number of cylinders of the plunger pump. Further, a sensor used for monitoring the liquid inlet manifold is disposed on the liquid inlet manifold, and the sensor used for monitoring the liquid inlet manifold in real time is a pressure sensor.

Optionally, a sensor used for monitoring the discharge manifold is disposed on the discharge manifold, and the sensor used for monitoring the discharge manifold in real time is a pressure sensor.

Optionally, sensors used for monitoring the reduction gearbox assembly are disposed on an outer surface of the reduction gearbox assembly, and the sensors used for monitoring the reduction gearbox assembly are a temperature sensor and a vibration sensor.

Optionally, the data analysis and diagnosis module includes a data storage module, a data analysis and processing module, and a data and fault display module; the data storage module has functions of monitoring the setting of the parameters of the system, setting a storage strategy, and real-time storing test data; the data analysis and processing module is configured to analyze and process real-time test data, and outputs status information of parts of the plunger pump based on the analysis; and the data and fault display module is configured to provide viewing of real-time monitoring data information of the plunger pump, display the status information of the parts of the plunger pump, and display and prompt the fault alarm information of the plunger pump.

Compared with the prior art, some of beneficial effects of the present disclosure are as follows: the diagnosis system monitors and diagnoses not only a hydraulic end assembly, but also a power end assembly and/or a reduction gearbox assembly, that is, an equipment fault can be accurately predetermined in time for an entire plunger pump, so that parts of the plunger pump operate in an optimal state, and high-pressure, large-displacement, and continuous operation requirements on fracturing sites at present are better satisfied. Instead of regular examination and maintenance, on-demand maintenance is performed at a proper time according to the condition of the monitored plunger pump, thereby saving labor, time, and materials to achieve economic efficiency; problems, the position of a fault, and a part to be replaced can be found as soon as possible, so that sudden emergencies are prevented, damages are reduced, and maintenance costs are reduced; the utilization of the plunger pump is improved; and the service life of the plunger pump is extended. The diagnosis system implements highly targeted prediction, especially, monitoring and diagnosis of a hydraulic end, and a professional worker does not need to perform monitoring and analysis. For the entire plunger pump, monitoring, acquisition, data comparison, and analysis are performed, and the data and fault display module is used to view data of the parts in real time, to raise an alarm as soon as fault occurs.

The present disclosure is described below in detail with reference to the accompanying drawings and specific implementations.

Figure 1:
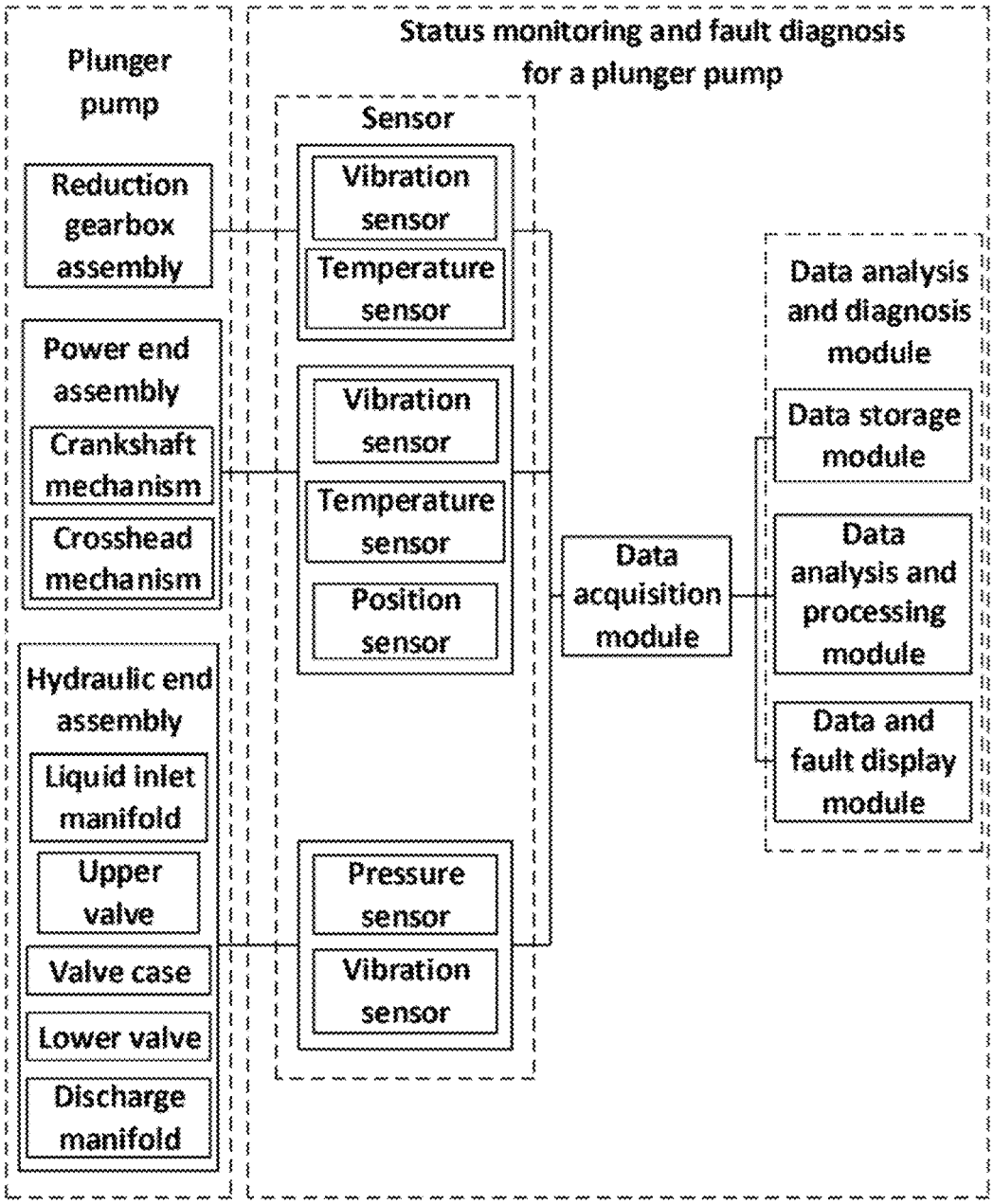
FIG. 1 is a schematic structural diagram of a status monitoring and fault diagnosis system for a plunger pump according to one embodiment of the present disclosure.
Figure 2:
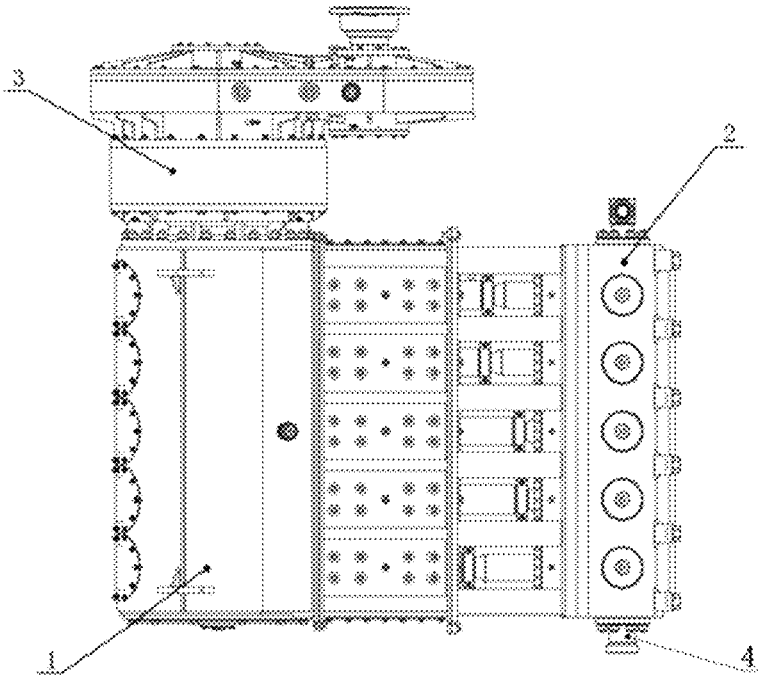
FIG. 2 is a schematic diagram of the external structure of a plunger pump viewed from the top according to one embodiment of the present disclosure.
Figure 3:
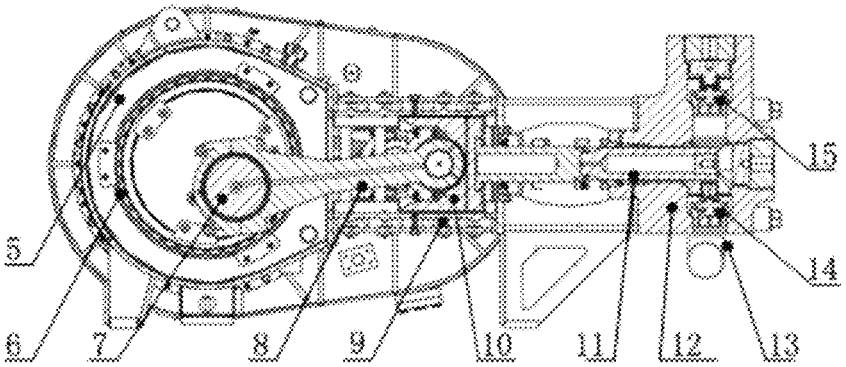
FIG. 3 is a schematic diagram of the internal structure of a plunger pump according to one embodiment of the present disclosure.

Wherein: 1. Power end assembly, 2. Hydraulic end assembly, 3. Reduction gearbox assembly, 4. Discharge manifold, 5. Power end housing, 6. Crankshaft bearing, 7. Crankshaft, 8. Connecting rod, 9. Crosshead case, 10. Crosshead mechanism, 11. Plunger, 12. Valve case, 13. Liquid inlet manifold, 14. Lower valve, and 15. Upper valve.

DESCRIPTION OF THE IMPLEMENTATIONS

In some embodiment, as shown in FIGS. 1 to 4, a status monitoring and fault diagnosis system for a plunger pump includes a monitoring and fault diagnosis device. The monitoring and fault diagnosis device monitors and diagnoses a hydraulic end assembly 2 of a plunger pump. The monitoring and fault diagnosis device further monitors and diagnoses a power end assembly 1 and/or a reduction gearbox assembly 3. The plunger pump includes the power end assembly 1, the hydraulic end assembly 2, and the reduction gearbox assembly 3. The power end assembly 1 includes a power end housing 5, a crosshead case 9, and a retainer. A crankshaft mechanism is disposed in the power end housing 5. The crankshaft mechanism includes a crankshaft 7 and a crankshaft bearing 6. A connecting rod 8, a crosshead mechanism 10, and the like are disposed in the crosshead case 9. The hydraulic end assembly 2 includes a valve case 12, a plunger 11, a suction valve, a discharge valve, an upper valve 15, a lower valve 14, and the like. The crankshaft 7 rotates over the crankshaft bearing 6. One end of the connecting rod 8 is connected to the crankshaft 7, and the other end of the connecting rod 8 is connected to the crosshead mechanism 10. The other end of the crosshead mechanism 10 is connected to the plunger 11 through a pull rod. An external power source drives the crankshaft 7 to rotate through the reduction gearbox assembly 3. The rotation of the crankshaft 7 is eventually converted into linear reciprocation of the plunger 11, to open or close the suction valve and the discharge valve. That is, the hydraulic end assembly 2 sucks in low-pressure liquid and discharges high-pressure liquid.

The monitoring and fault diagnosis device includes a plurality of sensors, a data acquisition module, and a data analysis and diagnosis module. The sensors are used for monitoring. The data acquisition module is connected to the sensor. The data acquisition module is configured to transfer signals detected by the sensors to the data analysis and diagnosis module. The sensors include temperature sensors, vibration sensors, pressure sensors, and position sensors. The data acquisition module is separately connected to the temperature sensors, the vibration sensors, the pressure sensors, and the position sensors. The data acquisition module is configured to: acquire signals output from the vibration sensors, the temperature sensors, the pressure sensors, and the position sensors, and transfer the signals to the data analysis and diagnosis module.

The monitoring and fault diagnosis device monitors and diagnoses the crankshaft bearing 6 of the power end assembly 1.

Sensors used for monitoring the crankshaft bearing 6 are disposed on an outer surface of the crankshaft bearing 6. The sensors used for monitoring the crankshaft bearing 6 are a temperature sensor and a vibration sensor. The sensors are used for monitoring real-time vibration and temperature of the crankshaft bearing 6 and outputting a vibration signal and a temperature signal of the crankshaft bearing 6.

The monitoring and fault diagnosis device monitors and diagnoses the crosshead mechanism 10 of the power end assembly 1.

Sensors used for monitoring the crosshead mechanism 10 are disposed on an outer surface of the crosshead case 9. The sensors used for monitoring the crosshead mechanism 10 are a temperature sensor and a vibration sensor. The sensors are used for monitoring real-time vibration and temperature of the crosshead mechanism 10 and outputting a vibration signal and a temperature signal of the crosshead mechanism 10.

The monitoring and fault diagnosis device monitors and diagnoses the crankshaft 7 of the power end assembly 1.

A sensor used for monitoring the crankshaft 7 is disposed on a side surface of a non-input end of the crankshaft 7. The sensor used for monitoring the crankshaft 7 is a position sensor. The plunger pump requires an external power source. Regardless of whether the power source is an electric motor or a turbine engine, the rotational speed needs to be reduced by the reduction gearbox assembly 3 before it can drive the crankshaft 7 to rotate. Therefore, an input end is one end, connected to the reduction gearbox assembly 3, of the crankshaft 7, that is, in terms of power input. The non-input end is the other end, opposite the input end, of the crankshaft 7. The crankshaft 7 includes a bellcrank and a journal. For example, a three-cylinder plunger pump has three bellcranks and four journals. A five-cylinder plunger pump has five bellcranks and six journals. The bellcranks and the journals are disposed alternately. The position sensor on the crankshaft 7 is used for monitoring a real-time angle of each bellcrank of the crankshaft 7 and outputting a position signal of the bellcrank of the crankshaft 7.

The monitoring and fault diagnosis of the hydraulic end assembly 2 includes monitoring and fault diagnosis of the valve case 12, a liquid inlet manifold 13, and a discharge manifold 4.

The monitoring and fault diagnosis of the valve case 12 further includes monitoring and fault diagnosis of the upper valve 15 and the lower valve 14. The hydraulic end assembly 2 is monitored comprehensively. The entire valve case and the upper valve 15 and the lower valve 14 in each cylinder are all monitored and diagnosed to find specific fault points as soon as possible. Compared with the prior art, it is not necessary to examine cylinders one by one.

A sensor used for monitoring the upper valve 15 and the lower valve 14 is disposed on an outer surface of the valve case 12. The sensor used for monitoring the valve case 12, the upper valve 15 and the lower valve 14 is a vibration sensor. The sensor is used for monitoring the vibration of the upper valve 15, the lower valve 14, and the valve case 12, and outputting vibration signals of the upper valve 15, the lower valve 14, and the valve case 12 at the hydraulic end.

The number of the vibration sensors disposed on the outer surface of the valve case 12 is set correspondingly according to the specific number of cylinders of the plunger pump. For example, if two vibration sensors form a group, the positions of each group of vibration sensors respectively correspond to the positions of the upper valve 15 and the lower valve 14 in each cylinder of the plunger pump. That is, a five-cylinder plunger pump is provided with five groups, and a three-cylinder plunger pump is provided with three groups. In such a design, highly targeted prediction is performed for a fault in each cylinder. Certainly, a vibration sensor may be further disposed on the valve case 12, to separately detect the valve case 12.

A sensor used for monitoring the liquid inlet manifold 13 is disposed on the liquid inlet manifold 13. The sensor used for monitoring the liquid inlet manifold 13 in real time is a pressure sensor. A sensor used for monitoring the discharge manifold 4 is disposed on the discharge manifold 4. The sensor used for monitoring the discharge manifold 4 in real time is a pressure sensor.

The plunger pump is a three-cylinder plunger pump, a five-cylinder plunger pump or the like. The quantity of cylinders is equal to the quantity of liquid inlets and the quantity of liquid outlets. One liquid inlet manifold 13 is separately connected to a suction valve of each cylinder, and one discharge manifold 4 is separately connected to a discharge valve of each cylinder. The three-cylinder plunger pump has three liquid inlet manifolds 13 and three discharge manifolds 4. One pressure sensor is mounted on each liquid inlet manifold 13 for monitoring the pressure at the liquid inlet manifold 13 of each cylinder and outputting a pressure signal of the liquid inlet manifold 13. One pressure sensor is mounted on each discharge manifold 4 for monitoring the pressure at the discharge manifold 4 of each cylinder and outputting a pressure signal of the discharge manifold 4.

Sensors used for monitoring the reduction gearbox assembly 3 are disposed on an outer surface of the reduction gearbox assembly 3. The sensors used for monitoring the reduction gearbox assembly 3 are a temperature sensor and a vibration sensor. The sensors are used for monitoring real-time vibration and temperature of the reduction gearbox assembly 3 and outputting a vibration signal and a temperature signal of the reduction gearbox assembly 3.

The data analysis and diagnosis module includes a data storage module, a data analysis and processing module, and a data and fault display module; the data storage module has functions of monitoring the setting of the parameters of the system, setting a storage strategy, and real-time storing test data; the data analysis and processing module is configured to analyze and process real-time test data, and outputs status information of parts of the plunger pump based on the analysis; and the data and fault display module is configured to provide viewing of real-time monitoring data information of the plunger pump, display the status information of the parts of the plunger pump, and display and prompt the fault alarm information of the plunger pump.

The data analysis and processing module analyzes a vibration sensing signal effective value of the crankshaft bearing 6, a temperature value, and an operation parameter of the plunger pump to determine the operation status of the crankshaft bearing 6. If a monitoring standard value is not exceeded, it is indicated that there is no fault. If the monitoring standard value is exceeded, data analysis is performed to determine the specific corresponding fault type, and alarm information is output at the data and fault display module for prompt and alarm.

The data analysis and processing module analyzes a vibration sensing signal effective value of the crosshead mechanism 10, a temperature value, and an operation parameter of the plunger pump, to determine the operation status of the crosshead mechanism 10 of the plunger pump. If a monitoring standard value is not exceeded, it is indicated that there is no fault. If the monitoring standard value is exceeded, data analysis is performed to determine the specific corresponding fault type, and alarm information is output at the data and fault display module for prompt and alarm.

The data analysis and processing module analyzes a measurement point of the position sensor of the crankshaft 7 to obtain a real-time angle of the bellcrank, to determine the operation statuses of the upper valve 15 and the lower valve 14 of the plunger pump. A vibration sensing signal effective value of each cylinder at the hydraulic end, pressure data of the suction manifold and the discharge manifold 4, and the operation parameter of the plunger pump are analyzed comprehensively to determine the movement statuses of the upper valve 15, the lower valve 14, and the valve case 12 on each cylinder at the hydraulic end of the plunger pump. If a monitoring standard value is not exceeded, it is indicated that there is no fault. If the monitoring standard value is exceeded, data analysis is performed to determine the specific corresponding fault type, and alarm information is output at the data and fault display module for prompt and alarm.

For the entire plunger pump, monitoring, acquisition, data comparison, and analysis are performed, and the data and fault display module is used to view data of the parts in real time, to raise an alarm as soon as fault occurs. A professional worker does not need to perform monitoring and analysis, and a plunger pump fault is found in time, so that the maintenance problems of the plunger pumps can be completely resolved.

A diagnosis method of the status monitoring and fault diagnosis system for a plunger pump is as follows:

(1) receiving signals of sensors mounted at parts of the plunger pump in real time by the data acquisition module;

(2) transferring the collected signals of the sensors to the data analysis and diagnosis module by the data acquisition module;

(3) storing test data by the data storage module, and analyzing the data of the sensors to determine the operation statuses of the parts of the plunger pump by the data analysis and processing module;

(4) determining whether parameters of the parts of the plunger pump exceed standards, and if yes, performing step 5, or if not, returning to step 1 to continue with real-time monitoring;

(5) extracting the fault signal features;

(6) determining a fault position and damage degree of a part by the data analysis and processing module, and presenting alarm information at the data and fault display module; and (7) determining whether to continue to operation by an operator according to the alarm information, and if yes, returning to step 1, or if not, stopping for examination and repair.

Figure 5:
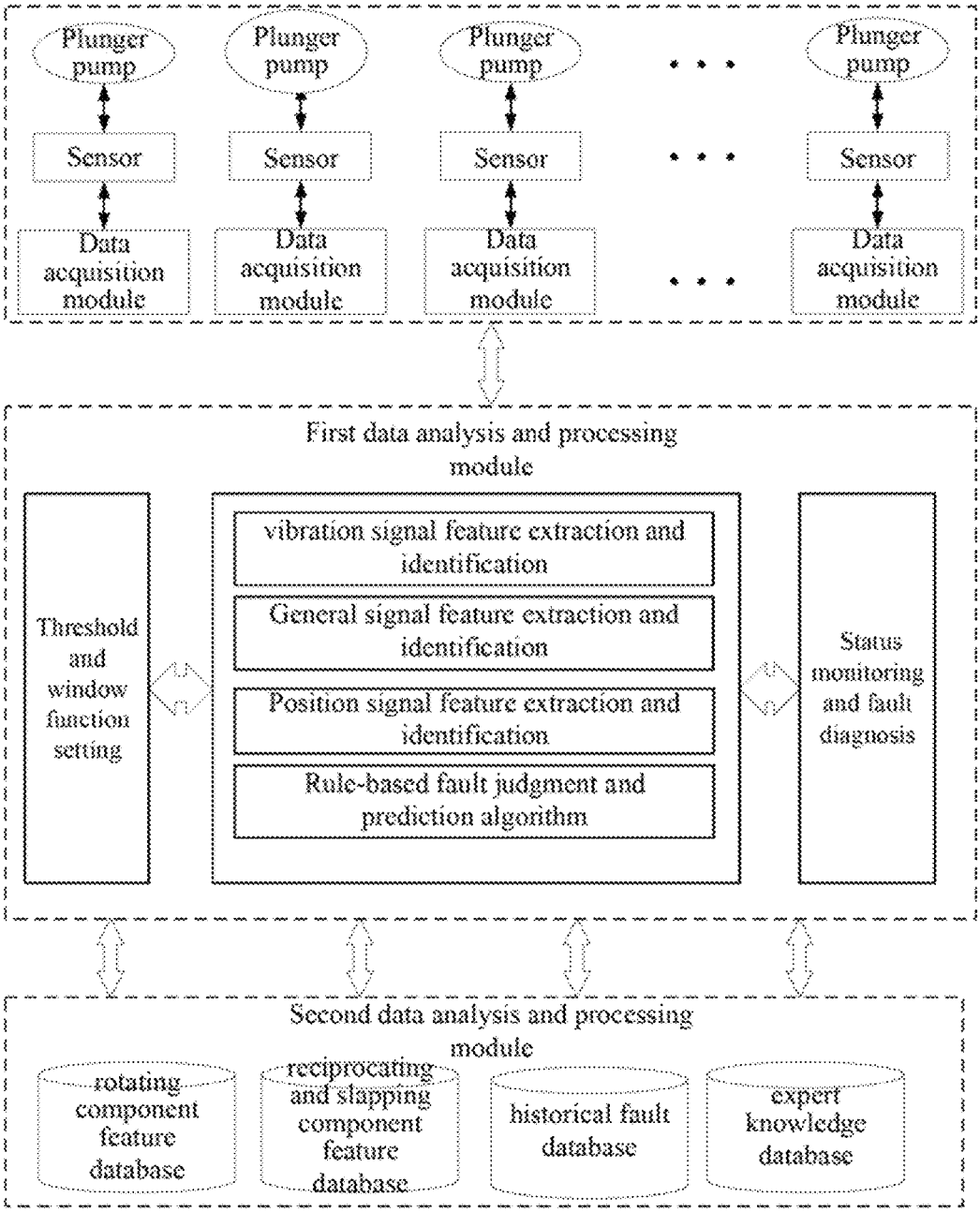
FIG. 5 is a logical block diagram of a signal acquisition module according to one embodiment of the present disclosure.

In some embodiments, as shown in FIGS. 1 and 5, the status monitoring and fault diagnosis system for a plunger pump may include a data acquisition module, a data analysis and diagnosis module, and a sensor assembly connected to the data acquisition module. The data analysis and diagnosis module may include a data storage module, a data analysis and processing module, and a data and fault display module. The data storage module may have functions of monitoring the setting of the parameters of the system, setting a storage strategy, and real-time storing test data; the data analysis and processing module may be configured to analyze and process real-time test data, and outputs status information of parts of the plunger pump based on the analysis. The data and fault display module may be configured to provide viewing of real-time monitoring data information of the plunger pump, display the status information of the parts of the plunger pump, and display and prompt the fault alarm information of the plunger pump. The data acquisition module may mainly include a vibration signal acquisition module, a general signal acquisition module, and a data transmission module. The data acquisition module may be responsible for receiving various sensor signals, preprocessing the signals, and packaging and transmitting the data. The sensor assembly may include: a vibration sensor and a temperature sensor installed on the gearbox; a vibration sensor, a temperature sensor, and a position sensor installed on the power end assembly, crankshaft and crosshead mechanism; and a vibration sensor and a pressure sensor installed on the hydraulic end assembly.

In some embodiments, the data analysis and processing module may include a first data analysis and processing module and a second data analysis and processing module. The first data analysis and processing module may include: a status monitoring and fault diagnosis module, a threshold and window function setting module, a vibration signal feature extraction and identification module cross-linked with the data of the threshold and window function setting module, a general signal processing module, a position signal feature extraction and identification module, and a rule-based fault judgment and prediction algorithm module.

The second data analysis and processing module may include a rotating component feature database, a reciprocating and slapping component feature database, a historical fault database and an expert knowledge database. The second data analysis and processing module may be used to provide reference data and technical support data for data analysis of the plunger pump.

After the data collected by the data acquisition module is processed by the vibration signal feature extraction and identification module and the general signal processing module in the first data analysis and processing module, then filtered through the threshold and window function setting module and the second data analysis and processing module, then compared with the data of each characteristic database, and finally processed by the rule-based fault judgment and prediction algorithm module to get the operating status of the main components of the pump.

Regarding rule-based fault judgment and prediction algorithms, for example, the judgement and prediction of power end assembly and reduction gearbox assembly may include the following steps:

(1) Determine whether it is a bearing vibration characteristic or a gear vibration characteristic:

In one embodiment, the filtered vibration signal features are compared with the "bearing feature" and "gear feature" signals of the rotating component feature database, and a bearing feature signal or a gear feature signal is determined;

(2) Compare the bearing characteristic signal and the gear characteristic signal with the reference data respectively to judge the operating status of the components;

(3) If the signal value exceeds the normal fluctuation range of its reference value, or is close to the warning value, compare the signal characteristics with the historical fault data to give a fault warning;

(4) Judge whether it is the bearing temperature signal or the power end crankshaft bearing temperature signal;

(5) If the signal exceeds the normal fluctuation range of its reference value, or the ascent rate exceeds the fluctuation range of the normal ascent rate, or is close to the warning value, the vibration and temperature signals must be compared comprehensively;

(6) If the vibration signal exceeds the normal fluctuation range of its reference value, and the temperature signal does not change, other vibration sensor signals must be taken into account, and determine whether it is affected by the vibration changes of other components;

(7) If the vibration signal exceeds the normal fluctuation range of its reference value, and the temperature signal exceeds the normal fluctuation range of its reference value, the basic judgment is that the bearing or the reduction box gear is at faulty;

(8) Compare the two information features with historical data, and give a fault warning.

In one embodiment, the judgement and prediction of the crosshead mechanism may include the following steps:

(1) Compare the vibration signal and the temperature signal with its reference data respectively;

(2) If the signal exceeds the normal fluctuation range of its reference value, or the ascent rate exceeds the fluctuation range of the normal ascent rate, or is close to the warning value, the vibration and temperature signals must be compared comprehensively;

(3) If the vibration signal exceeds the normal fluctuation range of its reference value, and the temperature signal does not change, other vibration sensor signals must be taken into account, and determine whether it is affected by the vibration changes of other components;

(4) If the vibration signal exceeds the normal fluctuation range of its reference value, and the temperature signal exceeds the normal fluctuation range of its reference value, the basic judgment is that the crosshead mechanism is at faulty;

(5) Compare the two information features with historical data, and give a fault warning.

In one embodiment, the judgement and prediction of the hydraulic end valve include the following steps:

(1) Combine the position sensor signal of the power end and the corresponding vibration signal of the hydraulic end;

(2) Determine the specific valve vibration according to the vibration amplitude level;

(3) Compare the vibration signal of each valve with its reference data to judge the operational status of the valve;

(4) If the vibration signal exceeds the normal fluctuation range of the reference value, compare the signal characteristics with the historical fault data to give a fault warning.

The above-mentioned so-called normal fluctuation range of the reference value is comprehensively set according to the data accumulation of the trial operation phase and the actual operation phase of the plunger pump. For example, the so-called normal fluctuation range of a reference value may be set between 95% and 105% of the reference value.

In some embodiments, the second data analysis and processing module may include an on-site data analysis and processing module and a rear data analysis and processing module. The on-site data analysis and processing module may include a rotating component feature database, a reciprocating and slapping component feature database, and a simplified historical fault database, which are stored in the computer of the plunger pump field data processing center. The rear data analysis and processing module may include a complete historical fault database and an expert knowledge database, which are stored in a remote big data center server. The computer of the plunger pump field data processing center may be connected to the remote big data center server through a network.

In one embodiment, the status monitoring and fault diagnosis system also may include an expert technical support module. The expert technical support module may be in communication connection with the second data analysis and processing module and the first data analysis and processing module. The expert technical support module may be used to transmit the field operation data of the plunger pump to the expert group when an unknown failure occurs, and at the same time, transmit the expert group's guidance to the field.

In some embodiments, operating a status monitoring and fault diagnosis system for a plunger pump, based on the above system, may includes the following steps:

S1. Collect the vibration and temperature of the plunger pump reduction gearbox, the crankshaft rotation speed at the power end, the vibration and temperature of the crankshaft bearing at the power end, the vibration and temperature of the crosshead, and the vibration value and pressure of the valve case at the hydraulic end.

S2. Analyze and process the data collected in step S1, and compare them with their respective reference data and technical support data in the second data analysis and processing module to obtain the operating status of the power end crankshaft and crankshaft bearings, the operating status of the bearings and gears on the input shaft and each rotating shaft in the reduction gearbox, the movement status of the crosshead, and the operating status of each valve core and valve body in the hydraulic end valve case.

S3. Provide fault warning and concurrent control information, and generate a report on the operating status of the plunger pump.

In one embodiment, in the step S2, the crankshaft connecting rod position is obtained, and the specific steps are as follows:

S2-1-1. Determine the relationship between the position sensor and the initial position of the crankshaft;

52-1-2. Obtain the pulse timing of the position sensor;

52-1-2. According to the mechanical structure parameters of the reduction gear, such as the reduction ratio of the reduction gear, the corresponding relationship between the radial position of the crankshaft connecting rod and the pulse of the position sensor is calculated.

In one embodiment, in the step S2, the operating status of the bearings and gears on the input shaft and each of the rotating shafts in the reduction box are obtained, and the specific steps are as follows:

S2-2-1. Obtain the input rotation speed through the position of the power source rotation speed sensor, and obtain the frequency of each rotating component in the reduction box according to the ratio of the rotation speed of each gear in the reduction box;

S2-2-2. Obtain the crankshaft rotation speed through the crankshaft position sensor, and obtain the frequency of the crankshaft and crankshaft bearings, crosshead, plunger and hydraulic end valves;

S2-2-3. Carry out signal processing on the vibration value of the crankshaft support seat at the power input end, convert the time domain signal into a frequency domain signal, and obtain the vibration components at different frequencies;

S2-2-4. Take the vibration component at the frequency corresponding to the input shaft and each of the rotating shafts in the gearbox, filter the signal through the threshold and window function setting module, and compare it with the data in the rotating component feature database and the historical fault database in the second data analysis and processing module, and use the rule-based fault judgment and prediction algorithm module for analysis to obtain the operating status of the bearing and gear on each rotating shaft and predict fault point.

Figure 6:
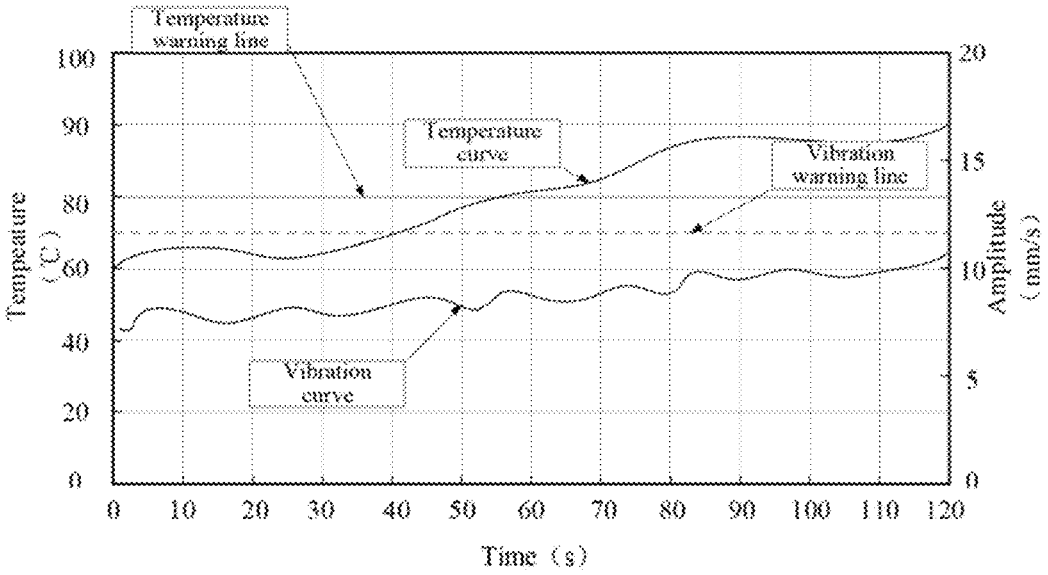
FIG. 6 is an exemplar graph of vibration and temperature according to one embodiment of the present disclosure.

In one embodiment, in the step S2, the operating status of the crosshead is obtained, and the specific steps are as follows:

S2-3-1. Obtain vibration data and temperature data installed on the outside of the crosshead;

S2-3-2. Perform signal filtering on the data of the above steps through the threshold and window function setting module, and compare it with the data in the reciprocating and slapping component feature database and the historical fault database in the second data analysis and processing module, and use the rule-based fault judgment and prediction algorithm module for analysis to obtain the operating status and fault warning of the crosshead. As shown in FIG. 6, after a long period of monitoring and operation, during the normal operation of the plunger pump, the vibration amplitude of the crosshead sliding sleeve body is generally below 20.4 mm/s, and the temperature of the cylinder shell is below 80 degrees Celsius. Therefore, the alarm threshold of the second vibration sensor is set to 20.4 mm/s and the alarm threshold of the temperature sensor is set to 80 degrees Celsius through the threshold and window function setting module. When the detected amplitude or temperature is close to the threshold, an alarm signal is issued to predict that the lubrication effect of the crosshead is not good, and immediate maintenance is required. The normal amplitudes and temperature values of different types of plunger pumps are quite different. These parameters need to be set according to the specific model.

In one embodiment, in the step S2, the operating status of each valve in the valve case is obtained, and the specific steps are as follows:

S2-4-1. Determine the current position of the plunger according to the pulse signal of the position sensor;

S2-4-2. Determine the current moving valve according to the position of the plunger;

S2-4-3. Associate the vibration signal and the pressure signal on the valve case of the hydraulic end with the moving valve;

S2-4-4. Perform signal filtering on the vibration data of the above steps through the threshold and window function setting module, and compare it with the data in the reciprocating and slapping component feature database and the historical fault database in the second data analysis and processing module, and use the rule-based fault judgment and prediction algorithm module to analyze and determine the operating status of the operating valve and predict the fault.

One beneficial effect of adopting the above-mentioned solution is that by matching the key phase positioning signal with the vibration signal, combined with an optimized sensor layout, the operating status of multiple valve components may be detected with a minimum number of sensors.

Figure 7:
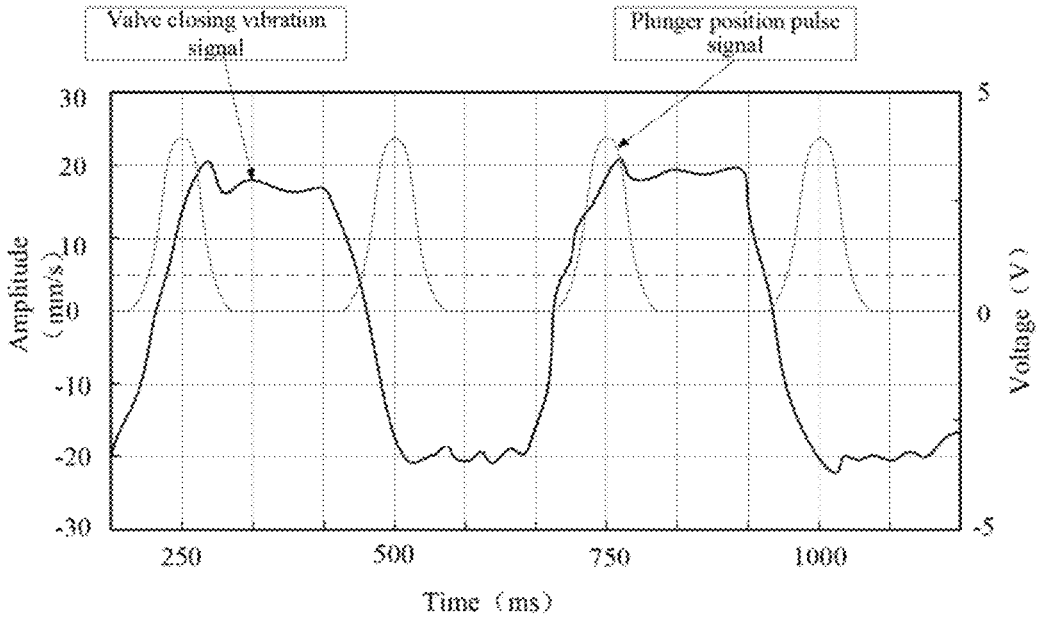
FIG. 7 is an exemplar operational vibration curve of a valve inside a valve case of a hydraulic end assembly according to one embodiment of the present disclosure.

As shown in FIG. 7, this figure describes the correspondence relationship between a pair of a valve vibration signal and a key phase encoding signal according to one embodiment of the present disclosure. Specifically, a pulse signal of each cylinder plunger is obtained through signals of the position sensors of the power end, and a movement speed of the plunger and a movement position of the plunger at each moment are obtained by judging the pulse signal of each cylinder plunger, thereby determining the state of the valve corresponding to each cylinder plunger. Corresponding vibration signal of the hydraulic end is obtained according to the valve motion state. The vibration signal of each valve is then compared with the reference data according to the vibration amplitude level and the motion state to determine the valve operating state. By comparing with the historical operating data of the valve, failures can be predicted.

Figure 4:
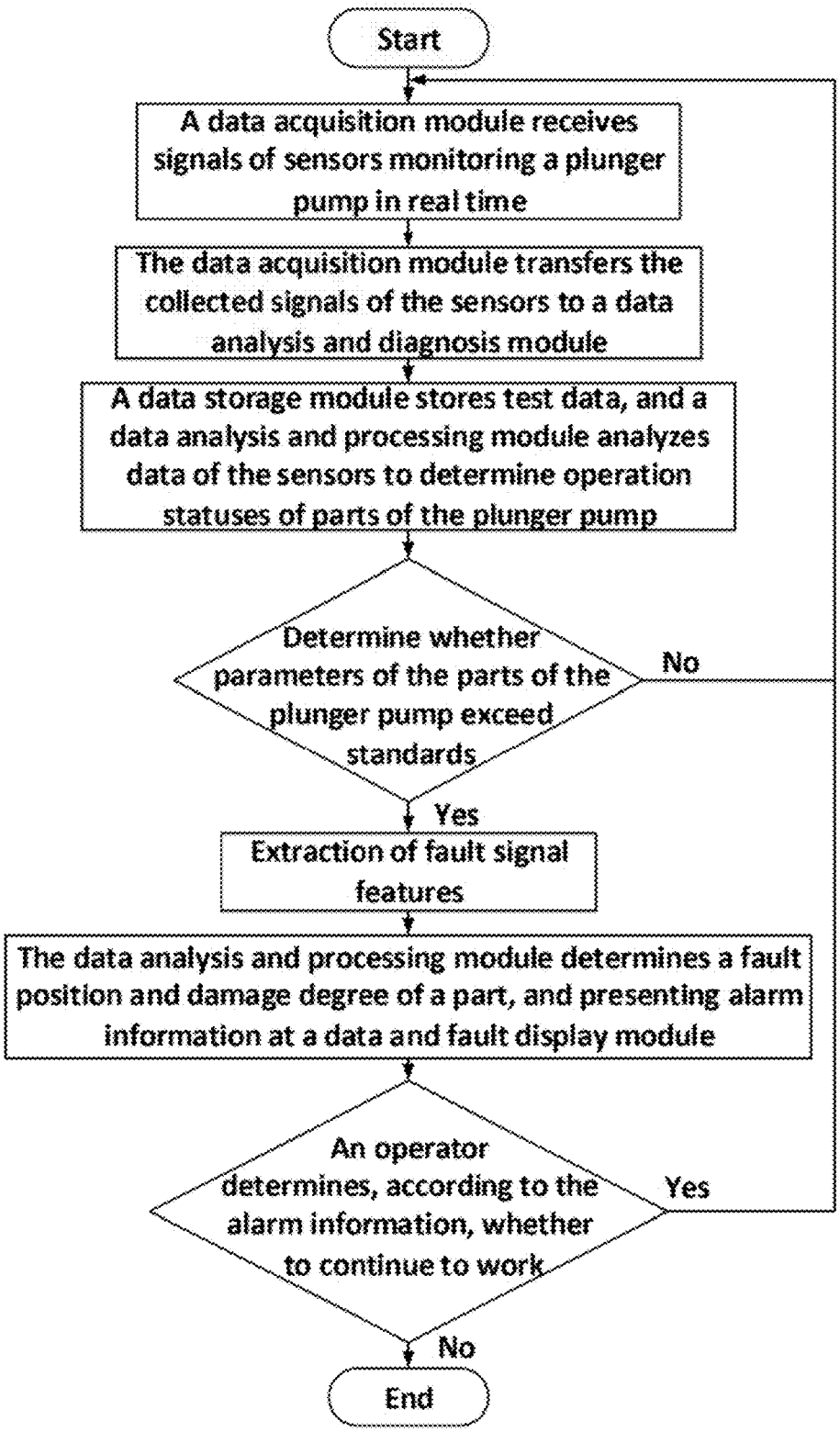
FIG. 4 is a method flowchart of a status monitoring and fault diagnosis system for a plunger pump according to one embodiment of the present disclosure.

Embodiments of the present disclosure can also provide a non-transitory computer-readable storage medium, having stored thereon computer instructions, wherein the computer instructions can be executed by one or more processors or circuitry to implement some operations of the method or system of FIGS. 1, 4, and 5. For example, the computer instructions can be executed by one or more processors or circuitry to implement operations of the data acquisition module and the data analysis and diagnosis module as shown in FIGS. 1, 4, and 5.

Processors according to embodiments of the disclosed subject matter may be, but is not limited to, a microcontroller unit (MCU), a central processing unit (CPU), a digital signal processor (DSP), or the like.

Computer-readable memory according to embodiments of the disclosed subject matter can be a tangible device that can store instructions for use by an instruction execution device (e.g., a processor or multiple processors, such as distributed processors). The storage medium may be, for example, but is not limited to, an electronic storage device, a magnetic storage device, an optical storage device, an electromagnetic storage device, a semiconductor storage device, or any appropriate combination of these devices. A non-exhaustive list of more specific examples of the storage medium includes each of the following (and appropriate combinations): flexible disk, hard disk, solid-state drive (SSD), random access memory (RAM), read-only memory (ROM), erasable programmable read-only memory (EPROM or Flash), static random access memory (SRAM), compact disc (CD or CD-ROM), digital versatile disk (DVD) and memory card or stick. A storage medium, as used in this disclosure, is not to be construed as being transitory signals per se, such as radio waves or other freely propagating electromagnetic waves, electromagnetic waves propagating through a waveguide or other transmission media (e.g., light pulses passing through a fiber-optic cable), or electrical signals transmitted through a wire.

Computer program and/or computer instructions described in this disclosure can be downloaded to an appropriate computing or processing device from a storage medium or to an external computer or external storage device via a global network (i.e., the Internet), a local area network, a wide area network and/or a wireless network. The network may include copper transmission wires, optical communication fibers, wireless transmission, routers, firewalls, switches, gateway computers and/or edge servers. A network adapter card or network interface in each computing or processing device may receive computer readable program instructions from the network and forward the computer readable program instructions for storage in a computer readable storage medium within the computing or processing device.

Computer program and/or computer instructions for implementing operations of the present disclosure may include machine language instructions and/or microcode, which may be compiled or interpreted from source code written in any combination of one or more programming languages, including assembly language, Basic, Fortran, Java, Python, R, C, C++, C# or similar programming languages. The computer program and/or computer instructions may execute entirely on a user's personal computer, notebook computer, tablet, or smartphone, entirely on a remote computer or computer server, or any combination of these computing devices. The remote computer or computer server may be connected to the user's device or devices through a computer network, including a local area network or a wide area network, or a global network (i.e., the Internet). In some embodiments, electronic circuitry including, for example, programmable logic circuitry, field-programmable gate arrays (FPGA), or programmable logic arrays (PLA) may execute the computer readable program instructions by using information from the computer readable program instructions to configure or customize the electronic circuitry, in order to perform aspects of the present disclosure.

Aspects of the present disclosure are described herein with reference to flowchart and block diagrams of methods, apparatus/equipment (systems), and computer program products according to embodiments of the disclosure. It will be understood by those skilled in the art that each block of the flowchart and block diagrams, and combinations of blocks in the flow diagrams and block diagrams, can be implemented by computer program and/or computer instructions.

It will be appreciated to persons skilled in the art that the present disclosure is not limited to the foregoing embodiments, which together with the context described in the specification are only used to illustrate the principle of the present disclosure. Various changes and improvements may be made to the present disclosure without departing from the spirit and scope of the present disclosure. All these changes and improvements shall fall within the protection scope of the present disclosure. The protection scope of the present disclosure is defined by the appended claims and equivalents thereof.

What is claimed is:

1. A method for repairing a plunger pump in real-time operation, comprising:

receiving real-time signals of a plurality of sensors disposed on a plurality of parts of the plunger pump;

determining a fault signal on a part of the plunger pump based on comparison of the real-time signals of the plurality of sensors to standard parameters of the plurality of parts of the plunger pump;

determining a fault position and damage degree of the part of the plunger pump based on the fault signal; and displaying and prompting fault alarm information of the part of the plunger pump based on the fault position and the damage degree.

2. The method of claim 1, further comprising:

stopping the plunger pump in the real-time operation based on the fault alarm information; and examining and/or repairing the part of the plunger pump based on the fault position and the damage degree.

3. The method of claim 1, wherein determining the fault signal on the part of the plunger pump based on comparison of the real-time signals of the plurality of sensors to standard parameters of the plurality of parts of the plunger pump comprises:

comparing the real-time signals of the plurality of sensors to standard parameters of the plurality of parts of the plunger pump, and determining a signal among the real-time signals of the plurality of sensors to be the fault signal under a condition that the signal exceeds its corresponding standard parameter of the part of the plunger pump.

4. The method of claim 1, further comprising transferring and storing the real-time signals of the plurality of sensors before determining the fault signal.

5. The method of claim 1, wherein the plunger pump comprises a hydraulic end assembly, and the plurality of sensors are configured to be mounted on the hydraulic end assembly.

6. The method of claim 5, wherein the plunger pump further comprises a power end assembly and a reduction gearbox assembly, and the plurality of sensors are further configured to be mounted on the power end assembly and/or the reduction gearbox assembly.

7. The method of claim 6, wherein a first group of sensors among the plurality of sensors are configured to be mounted on a crankshaft bearing of the power end assembly for monitoring the crankshaft bearing.

8. The method of claim 7, wherein the first group of sensors are disposed on an outer surface of the crankshaft bearing, and the first group of sensors include a temperature sensor and/or a vibration sensor.

9. The method of claim 6 wherein a second group of sensors among the plurality of sensors are configured to be mounted on a crosshead mechanism of the power end assembly for monitoring the crosshead mechanism.

10. The method of claim 9, wherein the second group of sensors are disposed on an outer surface of a crosshead case, and the second group of sensors include a temperature sensor and/or a vibration sensor.

11. The method of claim 6, wherein a third group of sensors among the plurality of sensors are configured to be mounted on a crankshaft of the power end assembly for monitoring the crankshaft.

12. The method of claim 11, wherein the third group of sensors are disposed on a side surface of a non-input end of the crankshaft, and the third group of sensors include a position sensor.

13. The method of claim 5, wherein the hydraulic end assembly comprises a valve case, a liquid inlet manifold, and a discharge manifold.

14. The method of claim 13, wherein the hydraulic end assembly further comprises an upper valve and a lower valve.

15. The method of claim 14, wherein a fourth group of sensors among the plurality of sensors are configured to be disposed on an outer surface of the valve case for monitoring the valve case, the upper valve, and/or the lower valve, and the fourth group of sensors include a vibration sensor.

16. The method of claim 15, wherein the number of the fourth groups of sensors disposed on the outer surface of the valve case is set correspondingly according to a specific number of cylinders of the plunger pump.

17. The method of claim 13, wherein a fifth group of sensors among the plurality of sensors are configured to be disposed on the liquid inlet manifold for monitoring the liquid inlet manifold, and the fifth group of sensors include a pressure sensor.

18. The method of claim 13, wherein a sixth group of sensors among the plurality of sensors are configured to be disposed on the discharge manifold for monitoring the discharge manifold, and the sixth group of sensors include a pressure sensor.

19. The method of claim 6, wherein a seventh group of sensors among the plurality of sensors are configured to be disposed on an outer surface of the reduction gearbox assembly for monitoring the reduction gearbox assembly, and the seventh group of sensors include a pressure sensor and a vibration sensor.

20. The method of claim 1, wherein the plurality of sensors comprises temperature sensors, vibration sensors, pressure sensors, and/or position sensors.

* * * * *